United States Patent [19]

George et al.

[11] 3,930,933

[45] Jan. 6, 1976

[54] DEBONDED CELLULOSE FIBER PULP SHEET AND METHOD FOR PRODUCING SAME

[75] Inventors: Donald K. George, Aiken; Joseph H. Angel, Columbia, both of S.C.

[73] Assignee: Riegel Textile Corporation, New York, N.Y.

[22] Filed: Nov. 25, 1970

[21] Appl. No.: 92,936

[52] U.S. Cl. ..... 162/179; 128/284; 162/158

[51] Int. Cl.[2] ..... D21D 3/00

[58] Field of Search ..... 162/158, 179; 128/284

[56] References Cited

UNITED STATES PATENTS

| | | | |
|---|---|---|---|
| 1,864,833 | 6/1932 | Kunz | 162/179 |
| 2,110,032 | 1/1938 | Williams | 162/158 |
| 3,395,708 | 8/1968 | Hervey et al. | 162/179 |
| 3,554,862 | 1/1971 | Hervey et al. | 162/158 |

*Primary Examiner*—S. Leon Bashore
*Assistant Examiner*—Arthur L. Corbin
*Attorney, Agent, or Firm*—Parrott, Bell, Seltzer, Park & Gibson

[57] ABSTRACT

A debonded cellulose fiber pulp sheet that is adapted to be fiberized by mechanical action to form a fluffy material and is impregnated with small amounts, such as 1% or less, of a long chain fatty alkyl cationic compound having at least 12 carbon atoms in at least one alkyl chain and a similar small or somewhat larger amount of an oily material such as a mineral, vegetable or animal oil which coacts with the cationic compound to render the pulp sheet easily mechanically fiberizable, and the resulting fiberized fluffy material softer, more lofty and more absorbent and method for producing said sheet.

7 Claims, No Drawings

DEBONDED CELLULOSE FIBER PULP SHEET AND METHOD FOR PRODUCING SAME

In a copending application of Laurence R. B. Hervey and Donald K. George Ser. No. 739,641, filed June 25, 1968, now U.S. Pat. No. 3,554,862, patented Jan. 12, 1971, there is disclosed a pulp sheet which has been rendered easily fiberizable by treating of the pulp slurry or wet pulp sheet with a relatively small amount, e.g. less than 1%, of a cationic long chain fatty alkyl compound having at least 12 carbon atoms in at least one alkyl chain. Following this treatment of the pulp slurry or wet pulp sheet, the sheet is dried and is adapted to be fiberized very easily with a minimum of broken fibers and the production of softer, more lofty and highly absorbent fluffy material. That application discloses various examples of the cationic chemical compounds which may be used to produce the debonded easily fiberizable sheet, including long chain fatty quaternary ammonium compounds and long chain fatty tertiary, secondary and primary amine compounds. The function of these compounds in improving the fiberizing properties of the pulp sheet appears to involve debonding of the cellulosic fibers so that they may be easily separated when subjected to a mechanical abrading action.

These long chain fatty chemical compounds, even when used in minute amounts of less than 1%, were found highly effective for debonding the cellulosic fibers and produced results that had not been obtainable prior to the invention disclosed in the above application. Prior attempts to obtain debonding of cellulosic fibers by addition of natural oils or similar oily materials were not effective and, at best, gave limited debonding when used in massive amounts, such as 10 to 40% by weight. The ineffectiveness of the oils for this purpose was apparently due to the oleophobic nature of the cellulose fibers which repelled the oils. In contrast thereto, the long chain fatty cationic chemicals are highly attracted to the cellulosic fibers and proved markedly effective for debonding of the fibers in extremely small amounts, e.g. 0.5% or slightly less.

In extending the initial research which led to the invention of the cellulose fiber debonding effectiveness of the cationic compounds disclosed in the above application Ser. No. 739,641, we have discovered that the same and, in fact, improved debonding effects may be obtained with an admixture of the cationic chemical and an oily material. This surprising result is contrary to the expected ineffectiveness of oils or oily materials when used alone and even in large amounts. This discovery is of substantial commercial importance from the standpoint of economy in the use of the cationic materials which are relatively costly even when used in small amounts. By admixing the oily material, e.g. natural vegetable or animal oil, with the long chain cationic compound, we have obtained excellent fiber debonding effects with as little as 0.15% to 0.3% of the cationic material admixed with up to two or three times such amounts of a natural oil, e.g., a low viscosity mineral oil. Moreover, we have found that the admixture of cationic chemical and oil improves very substantially the fiberizing properties of the same sheet when treated with the cationic material alone or with oil alone even in large amounts of the latter.

Illustrative but non-limiting examples of the treatment of the cellulosic pulp with the admixture of cationic materials and oil in accordance with the present invention, and the distinctly inferior results obtained when using the cationic material or the oil alone, are given below:

a. To an unbeaten sulphate pulp slurry containing 100 grams of dry pulp, there is added a well-blended mixture of 0.25 grams of ARQUAD 2HT-75, dimethyldi (hydrogenated tallow) ammonium chloride produced by Armour & Co., and 0.50 grams of white mineral oil. This mixture is allowed to stand for five minutes to allow intimate contact and then is formed into a sheet using a standard laboratory mold. The dewatered sheet is pressed between felts and dried on a steam can drier to yield a soft pulp sheet which is easily fluffed by fingernail friction into a loose, lofty mass of unbroken fibers.

b. A second sheet is formed as in (a) except that only the 0.25 grams of ARQUAD 2HT-75 is used. This sheet, while relatively soft, is fiberizable only with great difficulty using the fingernail and yields a noticeably less fluffy mass of fibers.

c. A third sheet is prepared as in (a) using no ARQUAD or oil and this sheet is found to be much too hard and tightly bonded to allow fiberization by the fingernail.

d. A fourth sheet is prepared as in (a) using only 0.5 grams of oil and this sheet is found to be essentially identical to the sheet as prepared in (c).

e. A sheet is prepared as in (a) using 0.30 grams of HYAMINE 3500, n-alkyl ($C_{12}$, $C_{14}$, $C_{16}$) - dimethyl benzyl ammonium chloride, produced by Rohm & Haas Co., and 0.50 grams of peanut oil. This sheet is somewhat darker in color but is otherwise easily fluffed and shows properties similar to those of sheet (a).

f. Sheets are prepared from 100 grams of sulfite pulp and (a) 0.25 grams of ARQUAD 2HT-75 plus 0.75 grams of mineral oil. (b) 0.30 grams of ARQUAD 2HT plus 0.5 grams of corn oil. (c) 0.25 grams of HYAMINE 3500 plus 0.5 grams of lard oil. (d) 0.30 grams of HYAMINE 3500 plus 0.80 grams of whale (sperm) oil.

Illustrative examples of the cationic chemicals which may be used in the present invention are as follows:

Quaternary mono cottonseed oil trimethyl ammonium chloride
mono coco trimethyl ammonium chloride
mono stearyl trimethyl ammonium chloride
mono oleyl trimethyl ammonium chloride
mono soya trimethyl ammonium chloride
dilauryl dimethyl ammonium chloride
di hydrogenated dimethyl ammonium chloride derived from a tallow oil
dimethyl ammonium chloride derived from soya oil
N-alkyl ($C_{12, 14, 16}$) dimethyl benzyl ammonium chloride
coco dimethyl benzyl ammonium chloride Tertiary mono stearyl dimethyl amine chloride Secondary di coco amine chloride
di hydrogenated tallow amine chloride
di oleyl amine chloride Primary dodecylamine chloride
palmitylamine chloride coco amine chloride
coco amine acetate
stearyl amine chloride
stearyl amine acetate
oleyl amine chloride
oleyl amine acetate
soya amine chloride
tallow amine chloride Illustrative but non-limiting examples of the oily materials which are to be admixed with the cationic chemicals in accordance with the present invention are peanut oil, mineral oils of a wide viscosity range, cottonseed oil, whale oil and lard oil. A commercially advantageous example is refined white oil commonly used for machine lubrication and for cosmetic purposes, e.g., Texaco white oil A.

Various other admixtures of cationic compounds and oils than those described above, which will effect debonding of the cellulosic fibers and various changes in the process conditions for producing the improved pulp sheet as described above, may be made in accordance with the spirit of the present invention and the scope of which is defined in the appended claims.

The "natural oil" referred to in the specification and claims herein is a non-drying type of oil illustrative examples of which are given hereinabove.

We claim:

1. A debonded cellulose fiber pulp sheet that is adapted to be fiberized easily by mechanical action to form a fluffy, lofty and absorbent fibrous material, said sheet being impregnated with an admixture of a long chain fatty alkyl cationic compound having at least 12 carbon atoms in at least one alkyl chain, and a natural non-drying oil which has no adverse effect on the pulp and which per se does not effect debonding of the fibers but coacts with the cationic compound to effect debonding of the fibers of the pulp sheet and thereby render it easily fiberizable.

2. A debonded cellulose fiber pulp sheet as defined in claim 1 and in which the amount of cationic compound is less than 1% and the oil is in an amount greater than 1% of the dry weight of the pulp sheet.

3. A debonded cellulose fiber sheet as defined in claim 1 and in which the cationic compound is a long chain fatty quaternary ammonium compound.

4. A debonded cellulose fiber pulp sheet as defined in claim 1 and in which the oil is a natural non-drying mineral oil.

5. A method of producing an easily fiberizable pulp sheet comprising introducing into the pulp before the sheet is dried, an admixture of a long chain fatty alkyl cationic compound having at least 12 carbon atoms in at least one alkyl chain, and a natural non-drying oil which has no adverse effect on the pulp and which per se does not effect debonding of the fibers but coacts with the cationic compound to effect debonding of the fibers of the pulp sheet and thereby render it easily fiberizable, and then drying the pulp sheet.

6. A method of producing an easily fiberizable pulp sheet as defined in claim 5 and in which the admixture of the cationic compound and oil is introduced into the pulp slurry before formation of the sheet.

7. A method of producing an easily fiberizable pulp sheet as defined in claim 5 and in which the admixture of cationic compound and oil is introduced into the preformed wet pulp sheet before it is dried.

* * * * *